US008436549B2

(12) United States Patent
Hasnain

(10) Patent No.: US 8,436,549 B2
(45) Date of Patent: May 7, 2013

(54) DRIVE CIRCUIT FOR A COLOR TEMPERATURE TUNABLE LED LIGHT SOURCE

(75) Inventor: Ghulam Hasnain, Livermore, CA (US)

(73) Assignee: Bridgelux, Inc., Livermore, CA (US)

( * ) Notice: Subject to any disclaimer, the term of this patent is extended or adjusted under 35 U.S.C. 154(b) by 209 days.

(21) Appl. No.: 12/856,009

(22) Filed: Aug. 13, 2010

(65) Prior Publication Data

US 2012/0038286 A1 Feb. 16, 2012

(51) Int. Cl.
*H05B 37/02* (2006.01)

(52) U.S. Cl.
USPC ..... 315/291; 315/156; 315/132; 315/159; 315/307

(58) Field of Classification Search ..... 315/149–159, 315/112–120, 291, 224, 307, 308
See application file for complete search history.

(56) References Cited

U.S. PATENT DOCUMENTS 6,384,545 B1 5/2002 Lau
6,975,079 B2 12/2005 Lys et al.
7,038,399 B2 5/2006 Lys et al.
7,135,824 B2 11/2006 Lys et al.
2002/0171373 A1* 11/2002 Muthu ..... 315/219
2003/0214242 A1* 11/2003 Berg-johansen ..... 315/169.3
2004/0066652 A1* 4/2004 Hong ..... 362/234
2004/0160199 A1* 8/2004 Morgan et al. ..... 315/312
2008/0265799 A1 10/2008 Sibert
2009/0001253 A1 1/2009 Blaut et al.
2010/0072901 A1* 3/2010 De Rijck et al. ..... 315/152
2010/0128472 A1 5/2010 Hancock et al.
2010/0264834 A1* 10/2010 Gaines et al. ..... 315/152

* cited by examiner

*Primary Examiner* — Shawki Ismail
*Assistant Examiner* — Christopher Lo

(57) ABSTRACT

A drive circuit for a color temperature tunable LED light source. An apparatus includes a current driver configured to output a first drive current to drive a first group of LED chips of the light source to emit first color temperature light and to output a second drive current to drive a second group of LED chips of the light source to emit second color temperature light. The apparatus also includes a controller coupled to the current driver and configured to control the first and second drive currents so that the first color temperature light and the second color temperature light combine to produce a resulting light having a selected color temperature and a selected intensity value.

54 Claims, 7 Drawing Sheets

500

502 504 506

| $T_{avg}$ (K) | Intensity(L) (100 lumens) | | Intensity(L) (50 lumens) | |
|---|---|---|---|---|
| | Drv1 ($I_w$) | Drv2 ($I_c$) | Drv1 ($I_w$) | Drv2 ($I_c$) |
| 3000 | 1.43 | 0 | .71 | 0 |
| 3500 | 1.19 | .17 | .60 | .08 |
| 4000 | .95 | .33 | .48 | .17 |
| 4500 | .71 | .50 | .36 | .25 |
| 5000 | .48 | .67 | .24 | .33 |
| 5500 | .24 | .83 | .12 | .42 |
| 6000 | 0 | 1.00 | 0 | .50 |

DRIVE CIRCUIT FOR A COLOR TEMPERATURE TUNABLE LED LIGHT SOURCE

BACKGROUND

1. Field

The present application relates generally to light emitting diodes, and more particularly, to a drive circuit for a color temperature tunable light emitting diode (LED) light source.

2. Background

A light emitting diode comprises a semiconductor material impregnated, or doped, with impurities. These impurities add "electrons" and "holes" to the semiconductor, which can move in the material relatively freely. Depending on the kind of impurity, a doped region of the semiconductor can have predominantly electrons or holes, and is referred to as an n-type or p-type semiconductor region, respectively.

In LED applications, an LED semiconductor chip includes an n-type semiconductor region and a p-type semiconductor region. A reverse electric field is created at the junction between the two regions, which cause the electrons and holes to move away from the junction to form an active region. When a forward voltage sufficient to overcome the reverse electric field is applied across the p-n junction, electrons and holes are forced into the active region and combine. When electrons combine with holes, they fall to lower energy levels and release energy in the form of light in the case of direct bandgap semiconductors such as gallium arsenide or indium phosphide. The color or wavelength of light emitted by an LED depends only on the composition of the semiconductor material. LEDs made from large bandgap semiconductors such as indium gallium nitride can convert electrical input energy to visible light, particularly blue light, with high conversion efficiency.

It is possible to create a white light source from one or more blue LED chips mounted typically on a ceramic or metal substrate, by encapsulating the chips with a suitable phosphor that absorb part of the blue light and fluoresce yellow since a combination of blue and yellow light appears white to the eye. Alternatively, a combination of red and green phosphors that absorb blue can be used to generate white light by a combination of red, blue and green. Furthermore, the white light source can be designed to emit white light having a particular color temperature. The color temperature of a white light source is the temperature of an ideal black-body radiator that radiates white light of comparable hue to that of the light source. The color temperature is conventionally stated in units of absolute temperature referred to as kelvin (K).

Typically, a white LED light source utilizes LED chips that emit blue light. Using a yellow phosphor encapsulation some of the blue light is converted to yellow light resulting in a combination which appears cool white to the eye. For example, cool white light has a color temperature of approximately 5500K. The further addition of green and red phosphors makes such a LED light source appear warm white. For example, warm white light has a color temperature of approximately 3000K.

Generally, people prefer a light source whose color temperature mimics that of the Sun. For example, it is desirable to have a cool color temperature light source (like the Sun at midday) to perform various detailed tasks and a warmer color temperature light source (like the Sun at dusk) for relaxing ambient lighting in the evening. A conventional incandescent light bulb exhibits these characteristics. For example, a light bulb at full power emits cool color temperature light, and when dimmed, emits warmer color temperature light.

Unfortunately, conventional LED light sources do not significantly change color temperature when dimmed from full power. This means that multiple LED light sources may be needed to satisfy different lighting requirements. For example, one LED light source may be needed to emit cool color temperature light during the day time and a second LED light source may be needed to emit warmer color temperature light for use in the evening.

Accordingly, there is a need for a color temperature tunable LED light source and associated drive circuit to provide light having warmer color temperatures when dimmed and cooler color temperatures when adjusted for full brightness.

SUMMARY

In various aspects, a drive circuit for a color temperature tunable LED light source is provided. In one implementation, the light source emits light having warmer color temperatures when dimmed and cooler color temperatures when adjusted for full brightness. In an aspect, the color temperature tunable LED light source comprises a plurality of LED chips mounted on a substrate. The LED chips are grouped into two or more groups, where each group of chips is encapsulated with a particular encapsulation material that converts the blue light from the LEDs to white light having a specific color temperature. Each group can be referred to as an encapsulation group and is driven by a drive current provided by the drive circuit so that the intensity (or lumen output) of each group can be controlled. By controlling the drive currents such that cool color temperature groups predominate when the LED light source is driven at full power and warm color temperature groups predominate when the LED light source is driven at lower power, it is possible to tune the color temperature of the resulting white light to achieve a particular color temperature characteristic. Thus, the drive circuit provides drive currents that operate to tune the color temperature of the white light emitted from the LED light source.

In another aspect, an apparatus is provided for driving a color temperature tunable light source. The apparatus comprises a current driver configured to output a first drive current to drive a first group of LED chips of the light source to emit first color temperature light and to output a second drive current to drive a second group of LED chips of the light source to emit second color temperature light. The apparatus also comprises a controller coupled to the current driver and configured to control the first and second drive currents so that the first color temperature light and the second color temperature light combine to produce a resulting light having a selected color temperature and a selected intensity value.

In another aspect, an apparatus is provided for driving a color temperature tunable light source. The apparatus comprises means for outputting a first drive current to drive a first group of LED chips of the light source to emit first color temperature light and to output a second drive current to drive a second group of LED chips of the light source to emit second color temperature light. The apparatus also comprises means for controlling the first and second drive currents so that the first color temperature light and the second color temperature light combine to produce a resulting light having a selected color temperature and a selected intensity value.

In another aspect, a method is provided for driving a color temperature tunable light source. The method comprises outputting a first drive current to drive a first group of LED chips of the light source to emit first color temperature light and to output a second drive current to drive a second group of LED chips of the light source to emit second color temperature light. The method also comprises controlling the first and second drive currents so that the first color temperature light and the second color temperature light combine to produce a resulting light having a selected color temperature and a selected intensity value.

In another aspect, a computer program product is provided for driving a color temperature tunable light source. The computer program product comprises a computer-readable medium embodying codes executable by a processor to output a first drive current to drive a first group of LED chips of the light source to emit first color temperature light and to output a second drive current to drive a second group of LED chips of the light source to emit second color temperature light. The computer-readable medium also embodies codes executable by a processor to control the first and second drive currents so that the first color temperature light and the second color temperature light combine to produce a resulting light having a selected color temperature and a selected intensity value.

It is understood that other aspects of the present invention will become readily apparent to those skilled in the art from the following detailed description. As will be realized, the present invention includes other and different aspects and its several details are capable of modification in various other respects, all without departing from the spirit and scope of the present invention. Accordingly, the drawings and the detailed description are to be regarded as illustrative in nature and not as restrictive.

BRIEF DESCRIPTION OF THE DRAWINGS

The foregoing aspects described herein will become more readily apparent by reference to the following Description when taken in conjunction with the accompanying drawings wherein.

DESCRIPTION

Figure 1:
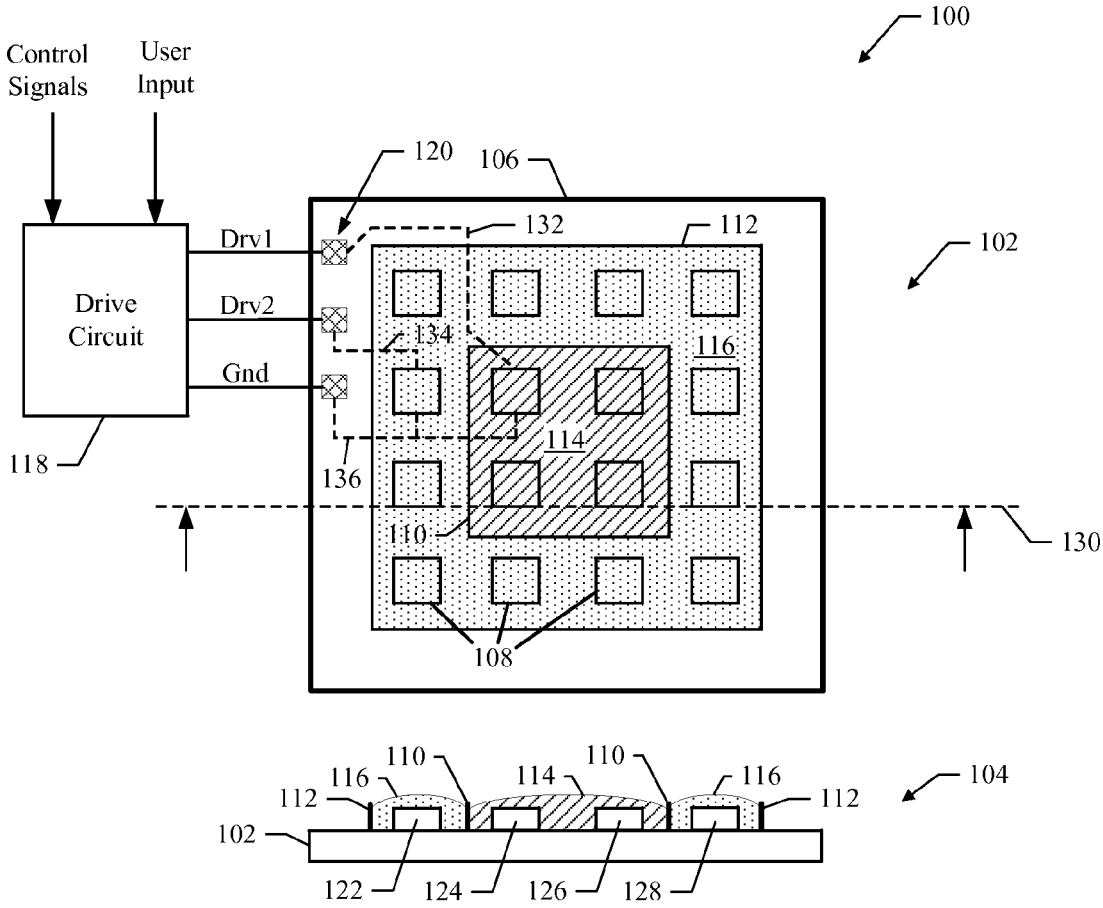
FIG. 1 shows top and cross-sectional views of an exemplary LED apparatus for use in aspects of a color temperature tunable LED light source.

The present invention is described more fully hereinafter with reference to the accompanying drawings, in which various aspects of the present invention are shown. This invention may, however, be embodied in many different forms and should not be construed as limited to the various aspects of the present invention presented throughout this disclosure. Rather, these aspects are provided so that this disclosure will be thorough and complete, and will fully convey the scope of the present invention to those skilled in the art. The various aspects of the present invention illustrated in the drawings may not be drawn to scale. Accordingly, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" sides of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items It will be understood that although the terms "first" and "second" may be used herein to describe various regions, layers and/or sections, these regions, layers and/or sections should not be limited by these terms. These terms are only used to distinguish one region, layer or section from another region, layer or section. Thus, a first region, layer or section discussed below could be termed a second region, layer or section, and similarly, a second region, layer or section may be termed a first region, layer or section without departing from the teachings of the present invention.

FIG. 1 shows a top view 102 and a cross-sectional view 104 of an exemplary LED apparatus 100 for use in aspects of a color temperature tunable LED light source. Referring to the top view 102, a substrate 106 is shown that comprises a plurality of LED chips (or dies) 108 mounted thereon and which emit blue light when suitably driven by a current source. A first group of the LED chips are located on the substrate 106 within boundary 110 and a second group of the LED chips are located outside boundary 110 and within boundary 112. The boundaries 110 and 112 form a ring or "dam" around the two groups of LEDs and are comprised of silicone or any other suitable material.

The first group of the LED chips is encapsulated by a first encapsulation material 114 and the second group of the LED chips is encapsulated by a second encapsulation material 116. For example, in one implementation, the first encapsulation material includes phosphor materials that are injected or otherwise introduced within the boundary 110 and operate to convert blue light emitted from the first group of the LEDs into white light having a warm color temperature. For example, warm color temperature light has a color temperature of approximately 3000K. Furthermore, the second encapsulation material includes phosphor materials that are injected or otherwise introduced between the first 110 and second 112 boundaries and operate to convert blue light emitted from the second group of the LEDs into white light having a cool color temperature. For example, cool color temperature light has a color temperature of approximately 5500K. In various implementations, the color temperature of the light emitted by the first group of LED chips is different than the color temperature of light emitted by the second group of LED chips. In an aspect, the difference in color temperature between the two groups of LED chips is at least 300K In various aspects, the encapsulation groups and their associated LED chips can be arranged in virtually any arrangement to facilitate light integration to support the color temperature tuning process. For example, as shown in FIG. 1, the first group of LED chips is located in a region within the second group of LED chips. However, in other implementations, the encapsulation groups and/or associated LED chips may be arranged or located on the substrate in any desired configuration to facilitate light integration to support the color temperature tuning process.

A drive circuit 118 receives one or more control signals and a user input and outputs a first drive current (Drv1) and a second drive current (Drv2) that are coupled to the substrate 106 at electrically conductive pads shown generally at 120. A return current path or ground (Gnd) is also coupled between the drive circuit 118 and the substrate 106. A first set of conductive traces, illustrated at 132, couple the first drive current from a first conductive pad to the first group of LED chips to allow the first drive current to control the intensity at which the first group of LEDs emits light. A second set of conductive traces, illustrate at 134, couple the second drive current from a second conductive pad to the second group of LED chips to allow the second drive current to control the intensity at which the second group of LEDs emits light. Return currents are coupled to a third conductive pad by conductive return traces, illustrated at 136.

The drive circuit 118 comprises circuitry operable to generate the first and second drive currents such that these currents are capable of driving the first and second groups of LEDs from an "off" state up to their full intensity. For example, either of the first and second drive currents may be a constant current or a pulsed current having any desired frequency or pulse rate. In various implementations, the drive circuit 118 generates the first and second drive currents based on one or more received control signals and/or user input. For example, the following is an exemplary (but not exhaustive) list of control signals that are received by the drive circuit and used to set or adjust the drive currents.

1. Ambient Indicators—Indicate information about the ambient environment such as ambient light color temperature or intensity.
2. Device Indicators—Indicate information about a light source such as emitted light color temperature or intensity. The device indicators can be used to detect process variations or degradation associated with LED chips or their encapsulation.
3. Timing indicators—Indicate information about various timing events such as the time of day or the status of a timed event.

A more detailed description of the drive circuit and the control signals is provided in another section of this document.

Referring now to the cross-sectional view 110 derived at the cross section indicator 130, the substrate 106 is shown. Mounted to the substrate 106 are LED chips 122 and 124 that are part of the first group and LED chips 126 and 128 that are part of the second group. The walls of the first and second boundaries 110 and 112 are also shown. Encapsulating LED chips 124 and 126 is the first encapsulation material 114 and encapsulating LED chips 122 and 128 is the second encapsulation material 116. The first encapsulation material converts blue light from the LED chips 124 and 126 into white light having a first color temperature. The second encapsulation material converts blue light from the LED chips 122 and 128 into white light having a second color temperature.

During operation, the drive circuit 118 outputs the first and second drive currents to control the light emitted from the first and second groups of LEDs. For example, based on the user input and/or the control inputs, the drive circuit 118 sets the levels of the first and second drive currents. This allows color temperature tuning of the light emitted from the LED apparatus 100. For example, when the first drive current is at its maximum and the second drive current is at its minimum then the resulting color temperature and intensity of the light emitted from the LED apparatus 100 primarily originates from the first group of LEDs and has a warm color temperature. Alternatively, when the first drive current is at its minimum and the second drive current is at its maximum then the resulting color temperature and intensity of the light emitted from the LED apparatus 100 primarily originates from the second group of LEDs and has a cool color temperature. Furthermore, if both groups are activated by the first and second drive currents, then the resulting color temperature and intensity is a combination of the light emitted from each group.

Thus, as the first and second drive currents are adjusted the resulting color temperature can be tuned since the resulting light emitted from the LED apparatus 100 is a combination of the color temperature and intensity of the light emitted from the first and second groups of LED chips. By adjusting the first and second drive currents, the LED apparatus 100 can provide tunable color temperatures such that warm color temperatures can be obtained by activating only the first group of LED chips, cool color temperature can be obtained by activating only the second group of LED chips, and intermediate color temperatures can be obtained by activating both the first and second groups of LED chips to emit light tuned to a desired color temperature. Therefore, the LED apparatus 100 provides for tuning the color temperature of the emitted light based on the user input and/or the control signals. It should also be noted that the LED apparatus 100 is not limited to having only two groups of LED chips, but in fact, may have any number of groups of LED chips each with a corresponding color temperature light output and the drive circuit 118 can be configured to output a corresponding number of drive currents; one for each group of LED chips.

Figure 2:
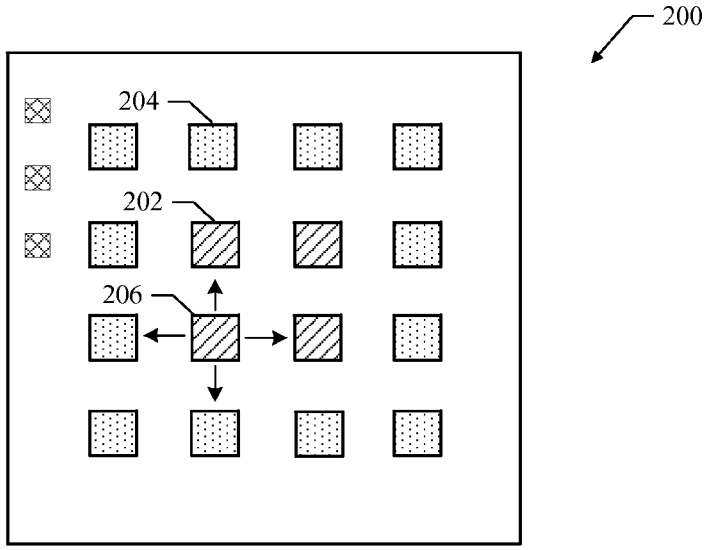
FIG. 2 shows an exemplary LED apparatus for use in aspects of a color temperature tunable LED light source.

FIG. 2 shows an exemplary LED apparatus 200 for use in aspects of a tunable LED light source. The LED apparatus 200 illustrates an alternative embodiment of the color temperature tunable LED light source.

In the LED apparatus 200, a die encapsulation process is used so that each LED chip has it own encapsulation. For example, LED chip 202 comprises a die encapsulation with a first encapsulation material and LED chip 204 comprises a die encapsulation with a second encapsulation material. Thus, because each LED chip has its own encapsulation, the LED apparatus 200 provides more flexibility in that the LED chips may be arranged and/or organized in any desired fashion (without the use of ring boundaries or dams) while still allowing any desired encapsulation material to be used for each chip and still allowing two or more LED encapsulation groups to be defined.

In various aspects, LED chips from each encapsulation group can be arranged in virtually any arrangement to facilitate light integration to support the color temperature tuning process. For example, LED chip 206 has four neighbor chips where two of the neighbor chips have the same encapsulation material and two of the neighbor chips have different encapsulation material. Thus, the LED chips for all groups can be arranged using a die encapsulation process so that any particular LED chip can have at least one neighbor that is encapsulated with the same or different encapsulation material.

Figure 3:
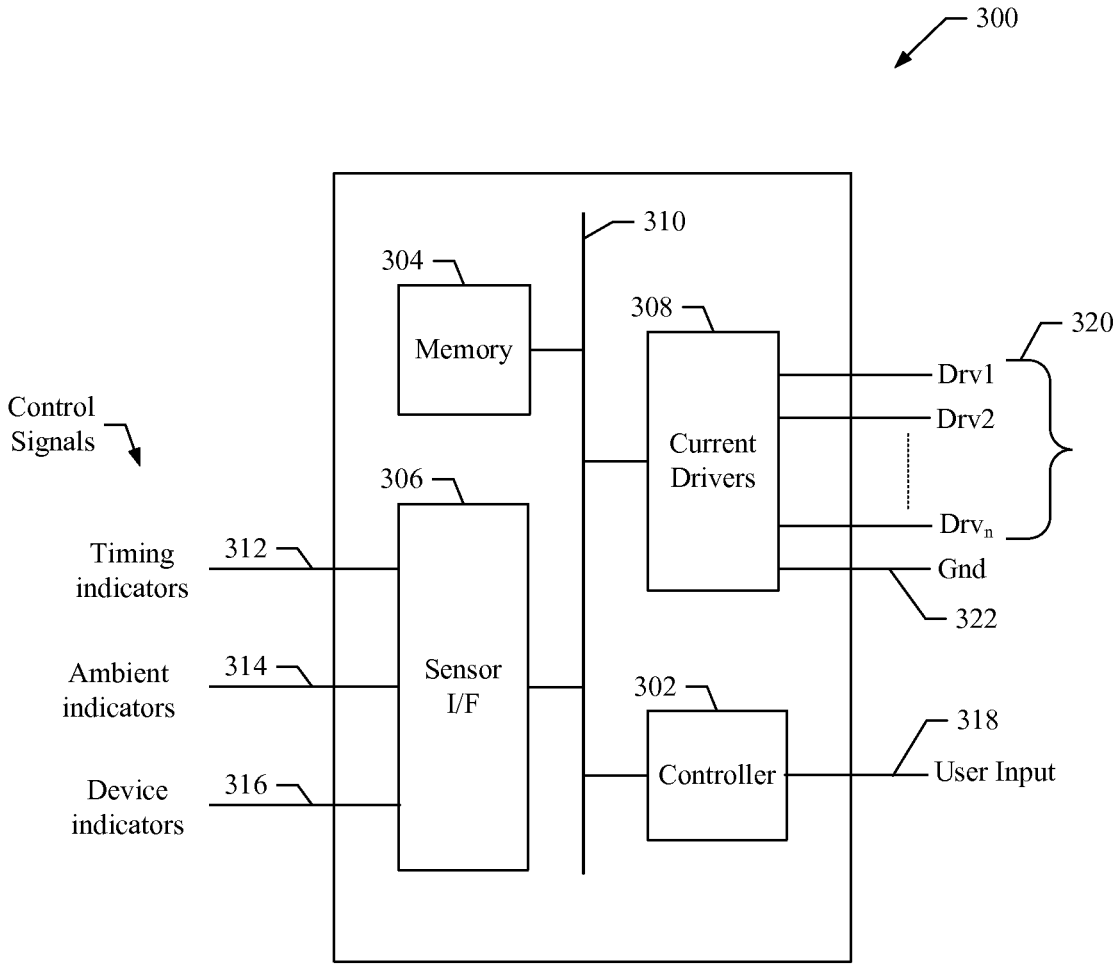
FIG. 3 shows an exemplary drive circuit for use in aspects of a color temperature tunable LED light source.

FIG. 3 shows an exemplary drive circuit 300 for use in aspects of a color temperature tunable LED light source. For example, the drive circuit 300 is suitable for use as the drive circuit 118 shown in FIG. 1. The drive circuit 300 comprises controller 302, memory 304, sensor interface 306, and current drivers 308 all coupled to communicate over communication bus 310. It should be noted that the drive circuit 300 is just one implementation and that other implementations are possible.

The memory 304 comprises RAM, ROM, EEPROM or any other type of memory device that operates to allow information to be stored and retrieved. The memory 304 is operable to store drive current tables that cross reference color temperature to drive currents at various intensity levels. The drive current tables stored in the memory 304 are accessible to the controller 302 and other modules of the drive circuit 300 using the bus 310. In one implementation, the drive current tables are stored in the memory during device manufacture. In another implementation, the drive current tables are stored in the memory by the processor 302, after acquiring the information from another device or through a communication link, such as a network connection.

The sensor interface 306 comprises one or more of a CPU, processor, gate array, hardware logic, memory elements, and/or hardware executing software. The sensor interface 306 operates to communicate with various sensors or other suitable devices to acquire various sensor information associated with the ambient environment, the light source device, or timing events. For example, the sensor interface 306 acquires timing indicators 312 such as time of day or the status of timed events. The timing indicators may be received from any suitable timing device or sensor.

The sensor interface 306 also acquires ambient indicators 314 that indicate parameters related to the ambient environment. For example, the ambient indicators comprise ambient light levels, ambient color temperature levels or any other parameters related to the ambient environment. The ambient indicators 314 may be obtained from one or more suitable devices sensors configured to measure the ambient environment The sensor interface 306 also acquires device indicators 316 that indicate parameters relative to the light source being driven by the drive circuit 300. For example, the device indicators 316 comprise light source color temperature, intensity, or any other parameters related to the light source. The device indicators 316 may be obtained from one or more suitable devices or sensors configured to obtain information about the light emitted from the light source device.

The current drivers 308 comprises hardware and/or hardware executing software that operates to output multiple drive currents ($Drv_x$) 320 that can be used to drive corresponding encapsulation groups of a color temperature tunable LED light source to allow color temperature tuning of the emitted light. In one aspect, the drive currents 320 are set to constant currents at predetermined voltage levels. In another aspect, the drive currents have selected current amplitudes that are pulsed at a selectable pulse rate. During operation, the current drivers 308 receive drive current parameters from the controller 302 and use these parameters to generate the appropriate drive currents. A ground (Gnd) 322 or return path for the drive currents is also provided.

The controller 302 comprises one or more of a CPU, processor, gate array, hardware logic, memory elements, and/or hardware executing software. The controller 302 operates to control the operation of the drive circuit 300 to generate drive currents to drive a color temperature tunable LED light source. The controller 302 operates to determine drive current parameters which are passed to the current drivers 308 and used to generate the drive currents 320. In an aspect, the controller 302 receives user input 318 which comprises parameters that are used in conjunction with other information, such as sensor information, to determine the drive current parameters. For example, the user input 318 interfaces to a keypad or other user input device.

During operation, the controller 302 operates to control the sensor interface 306 to acquire control signal information. Furthermore, the controller 302 operates to receive information from the user input 318. After acquiring the control signal information and user input information the controller 302 determines the desired color temperature and intensity of the light to be emitted from the light source. The following illustrate how the controller 302 determines the desired color temperature value for the emitted light. It should be noted that the controller 302 is not limited to the operations described below and may perform any other operations utilizing the available information to determined the desired color temperature and/or intensity value of the emitted light.

User Input

In an aspect, the controller 302 receives information from the user input 318 and uses this information to determine the desired color temperature and/or intensity of the emitted light. For example, a user may indicate that the color temperature and/or intensity of the emitted light are to be increased or decreased by a selected amount. For example, the user inputs this information to the controller 302 via an input keypad. In one case the user may indicate that the color temperature and/or intensity are to be changed by a particular amount or percentage. In another case, the user may indicate that the color temperature and/or intensity are to be set to specific levels. Furthermore, the user may enter programming information that indicates the desired color temperature and/or intensity level to be set after the occurrence of selected events, such as time of day events, or ambient conditions.

Timing Indicators

In an aspect, the controller 302 receives the timing indicators 312 and uses this information to determine the desired color temperature and/or intensity of the emitted light. For example, a particular time of day or the completion of a measured time interval may indicate that the color temperature and/or intensity of the emitted light are to be increased or decreased by a selected amount. For example, the user may input the color temperature to be used at specific times during the day. The controller 302 determines whether those times have occurred from the timing indicators and sets the color temperature and/or intensity of the emitted light accordingly.

Ambient Indicators

In an aspect, the controller 302 receives the ambient indicators 314 and uses this information to determine the desired color temperature and/or intensity of the emitted light. For example, a particular time of day the color temperature and/or intensity of the ambient light may reach a specified level. The user may indicate through the user input 318 what these levels are. Once these levels are reached, the controller 302 operates to set the color temperature and/or intensity of the emitted light to predetermined levels.

Device Indicators

In an aspect, the controller 302 receives the device indicators 316 and uses this information to determine the desired color temperature and/or intensity of the emitted light. For example, the device indicators 316 indicate the color temperature and intensity of the light currently being emitted by the light source. This information functions as a feedback for the drive circuit 300 in that the controller 302 can use this information to verify that light having the desired color temperature and intensity is being emitted from the light source. The device indicators can be use to compensate for process variations during manufacture with regards to the LED chips used in the light source or variations in the phosphor encapsulation material.

In an aspect, to achieve consistent light output from all manufactured light sources, the controller 302 can use the device indicators to determine whether the color temperature and/or intensity of the emitted light needs to be changed to maintain a particular light output. For example, if the light source is to emit light having a color temperature of 4500K and the device indicators indicate that the emitted light is actually 4800K due to process variation, then the controller 302 can adjust the color temperature of the light output to maintain the correct value.

In another aspect, to compensate for degradation of the LED chips or the phosphor encapsulation material, the controller 302 can use the device indicators to determine whether the color temperature and/or intensity of the emitted light needs to be changed to maintain a particular light output. For example, if the light source is to emit light having a color temperature of 4500K and the device indicators indicate that the emitted light is actually 4800K due to degradation of the LEDs, or phosphor encapsulation, then the controller 302 can adjust the color temperature of the light output to maintain the correct value.

Once the controller 302 determines what the color temperature and/or intensity of the emitted light should be, the controller 302 accesses the memory 304 with color temperature/intensity information to determine the appropriate drive currents. For example, the controller 302 accesses the drive current tables in the memory 304 to determine the drive currents necessary to achieve a desired light output. The controller 302 may also directly compute the drive currents as described in another section of this document.

Once the controller 302 has determined the appropriate drive currents the controller 302 generates drive current parameters that are passed to the current drivers 308, which uses these parameters to generate the appropriate drive currents 320 to obtain the desired light output. Thus, the controller 302 operates to receive user input and various control signals to determine the desired color temperature and/or intensity of the light source output. This information is then used to cross reference the drive current tables in the memory 304 to determine the appropriate drive current values. The drive current values are passed to the current drivers 308 so that drive currents can be generated to drive the light source to emit light having the desired color temperature and/or intensity.

In various implementations, the drive circuit 300 comprises a computer program product having one or more program instructions ("instructions") or sets of "codes" stored or embodied on a computer-readable medium. When the codes are executed by at least one processor, for instance, a processor at the controller 302, their execution results in the functions of the drive circuit 300 described herein. For example, the computer-readable medium comprises a floppy disk, CDROM, memory card, FLASH memory device, RAM, ROM, or any other type of memory device or computer-readable medium that interfaces to the drive circuit 300. In another aspect, the sets of codes may be downloaded into the drive circuit 300 from an external device or communication network resource. The sets of codes, when executed, operate to provide aspects of the color temperature tunable light source as described herein.

Figures 4, 5:
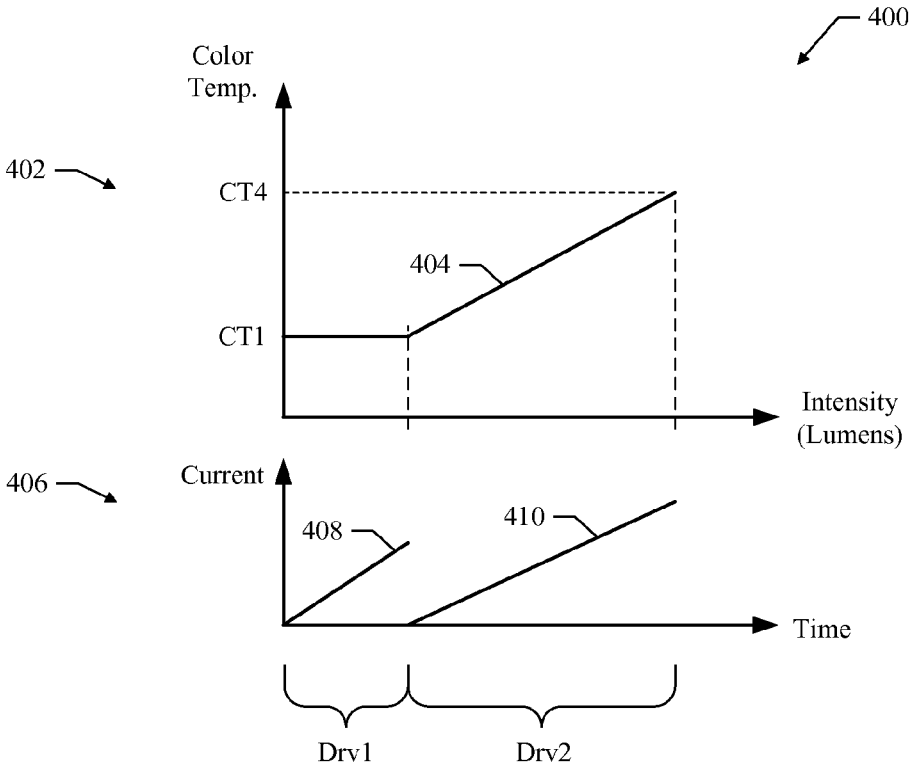
FIG. 4 shows exemplary graphs illustrating the operation of the LED apparatus shown in FIG. 1.
FIG. 5 shows an exemplary drive current table for use in aspects of a color temperature tunable LED light source.

FIG. 4 shows exemplary graphs 400 illustrating the operation of the LED apparatus 100 shown in FIG. 1. The graph 402 shows plot line 404 that illustrates the resulting color temperature and intensity of light emitted from the LED apparatus 100 during operation. The graph 406 shows plot lines 408 and 410 that illustrate the amplitude of the first (Drv1) and second (Drv2) drive currents.

As the amplitude of the first drive current increases (as shown at 408) the intensity of the emitted warm color temperature white light increase while the color temperature remains constant, as shown in the graph 404. As the amplitude of the second drive current increases (as shown at 410), the resulting intensity of the emitted light increases while the resulting color temperature shifts to the second color temperature, as shown in the graph 404.

In one implementation, the first drive current is maintained at a fixed value while the second drive current is adjusted from its minimum value to its maximum value. Thus, initially the emitted light has a warm color temperature and intensity determined from the first group of LED chips. As the second drive current increases, the emitted light has a color temperature and intensity determined from a combination of the first and second groups of LED chips. As the second drive current continues to increase to its maximum value, the emitted light has a cool color temperature and intensity determined primarily from the second group of LED chips. Thus, the graph 400 illustrates how the LED apparatus 100 provides a tunable color temperature light output that provides an approximately linear relationship between color temperature and lumen output.

It should also be noted that it is possible to adjust the drive currents to achieve the same color temperature light with different intensity levels. For example, if the intensity is increase but the same ratio of light from the two groups of LED chips is maintained, only the intensity of the light will increase but the color temperature will remain the same. The information presented in the graphs 400 is quantified in the exemplary drive current table provided in FIG. 5.

FIG. 5 shows an exemplary drive current table 500 illustrating the relationship between color temperature and drive currents. For example, the drive current table 500 may be stored in the memory 304 for use during operation of the drive circuit 300.

The drive current table 500 comprises a color temperature column 502, and two intensity levels 504 and 506 that relate color temperature to drive current according to the relationships illustrated in FIG. 4. In each of the first and second intensity levels 504, 506, drive currents are shown associated with each color temperature. Thus, for any particular color temperature, drive currents can be determined that will result in emitted light having that color temperature at the desired intensity.

Mathematical Computation of Drive Currents

Typically the light output of a white LED, measured in lumens, is proportional to its drive current, with the proportionality constant dependent on the color temperature assuming all other factors being equal. For example, a white LED source that can be driven with current up to one amp may produce light at the rate of 100 lumens per amp when configured as a 6000K cool-white source, but when configured as a 3000K warm-white source may only produce light at the rate of 70 lumens per amp.

Color Temperature Tuning Example

The following is an example that illustrates how the first and second drive currents can be mathematically computed to produce light having a desired intensity and color temperature. For example, the controller 302 is operable to perform the following calculation to determined necessary drive currents.

It will be assumed that the first group of LED chips are encapsulated with the first encapsulation material and emit a warm white light having a color temperature of $T_w$ Kelvin. Then the intensity of the warm white light that is emitted in lumens ($L_w$) can be determined from the following expression;

$$L_w = W^* I_w \tag{1}$$

where $L_w$ is the warm-white light intensity in lumens produced by the first group of LED chips when driven by the first drive current (Drv1) of $I_w$ amps, with W representing a constant of efficacy in lumens per amp of the first group of LED chips.

Similarly, it will also be assume that the second group of LED chips are encapsulated with the second encapsulation material and emit a cool white light having a color temperature of $T_c$ Kelvin. Then the intensity of the cool white light that is emitted in lumens ($L_c$) can be determined from the following expression;

$$L_c = C^* I_c \tag{2}$$

where $L_c$ is the cool-white intensity in lumens produced by the second group of LED chips when driven by the second drive current (Drv2) of $I_c$ amps, with C representing a constant of efficacy in lumens per amp of the second group of LED chips.

Then the total intensity of light in lumens ($L_T$) that is produced can be determined from the following expression;

$$L_T = L_c + L_w = C^* I_c + W^* I_w \tag{3}$$

Furthermore, the perceived average color temperature ($T_{avg}$) of the light produced when combining the light emitted from both groups of LED chips can be determined by superposition according to the following expression;

$$T_{avg} = (L_c^* T_c + L_w^* T_w)/(L_c + L_w) \tag{4}$$

Therefore, using algebraic manipulations it can be shown that the values of the two drive currents (Drv1=$I_w$ and Drv2=$I_c$) that are needed for the two groups of LED chips to produce a total light output of $L_T$ lumens at a average color temperature $T_{avg}$ Kelvin can be determined from the following expressions;

$$I_w = L/W^* [(T_c - T)/(T_c - T_w)] \tag{5}$$

$$I_c = L/C^* [(T - T_w)/(T_c - T_w)] \tag{6}$$

Using the above equations, it is possible for the controller 302 to determine the current drive values to complete the table 500. For example, the controller 302 can determine the values of drive currents that would be used to produce a range of color temperatures for the two intensity levels of total light output. It should be noted that although two intensity levels are provided in FIG. 5, the drive current table 500 may include any number of intensity levels and the controller 302 may also directly compute the drive currents to produce the desired color temperature and any desired intensity level.

Figure 6:
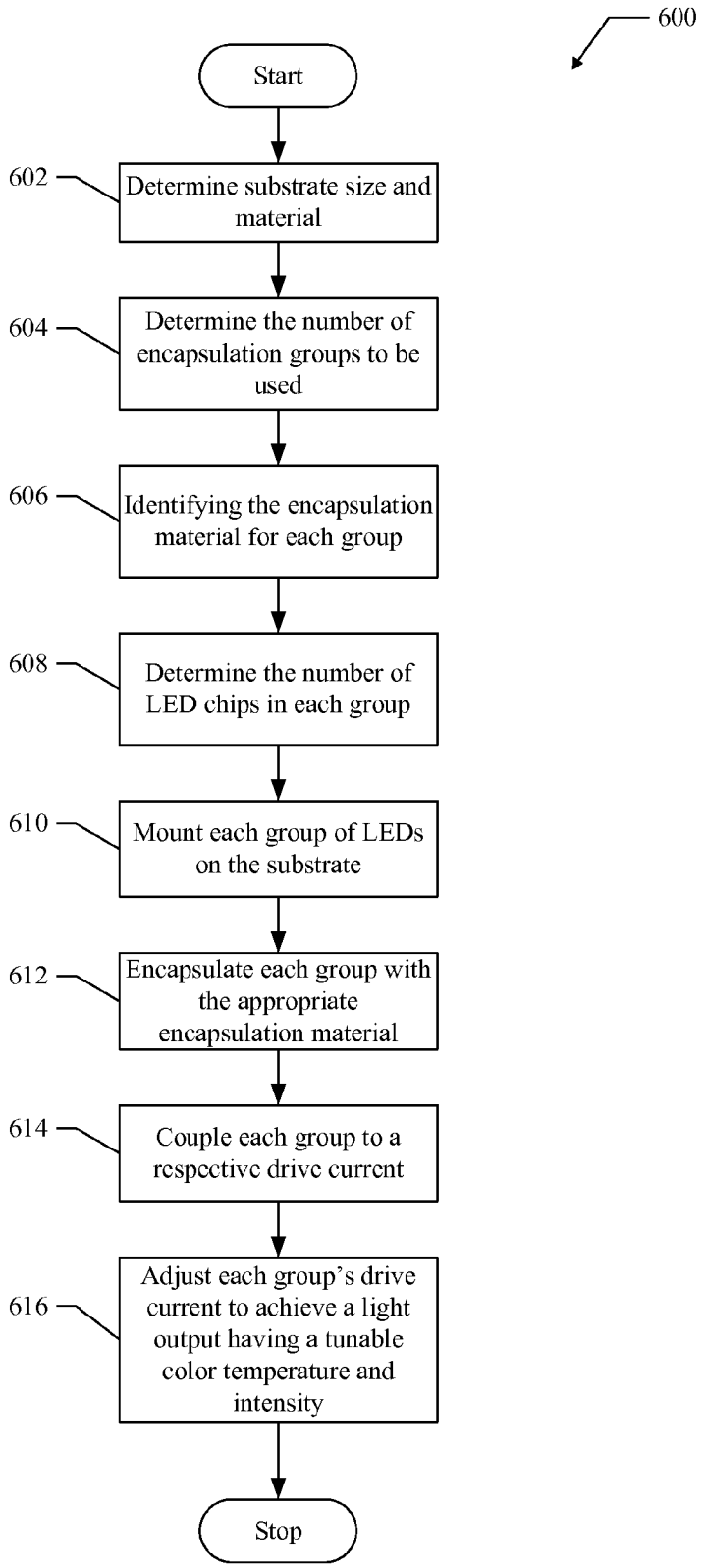
FIG. 6 shows an exemplary method for providing a color temperature tunable LED light source.

FIG. 6 shows an exemplary method 600 for providing a color temperature tunable LED light source.

At block 602, a substrate size and material is determined. For example, the size and material of the substrate 106 shown in FIG. 1 is determined.

At block 604, the number of encapsulation groups is determined. For example, various embodiments of the invention are suitable for use with any number of encapsulation groups. Each encapsulation group will comprise one or more LEDs encapsulated with a particular encapsulation material that output light having a particular color temperature.

At block 606, encapsulation material for each group is identified. For example, a first group can have an encapsulation material the converts blue LED output to a warm white color temperature and a second group can have an encapsulation material the converts blue LED output to a cool white color temperature.

At block 608, the number of LED chips in each group is determined. For example, the number of LED chips in each group affects the intensity of light emitted by that group which in turn affects how light emitted from each group combines with other groups to produce a resulting light output.

At block 610, the LEDs for each group are mounted on the substrate. In an aspect, the LEDs are mounted in any arrangement or are organized in any fashion to allow encapsulation with the appropriate material and to allow light emitted from each group to combine with other groups to be perceived as an integrated light source.

At block 612, each encapsulation group is encapsulated with the appropriate encapsulation material. For example, each LED in a particular group is encapsulated with the encapsulation material identified for that group. In one implementation, multiple LED chips are encapsulated together by surrounding them with a boundary material and injecting the encapsulation material to cover all LED chips within the boundary. In another implementation, each LED chip in a group is encapsulated with the appropriate encapsulation material using a die encapsulation technique.

At block 614, the LED chips of each group are coupled to receive a drive current for each group, respectively. For example, if there are three encapsulation groups, then there are three drive currents; one for each group.

At block 616, each group's drive current is adjusted so that the device emits a resulting light output having a particular color temperature and intensity. For example, the drive circuit 118 operates to adjust the first and second drive currents based on received control signals and/or user input as described above.

Therefore, the method 600 operates to providing a color temperature tunable LED light source in accordance with aspects of the present invention. It should be noted that the operations of the method 600 may be rearranged or otherwise modified within the scope of the various aspects. Thus, other implementations are possible with the scope of the various aspects described herein.

Figure 7:
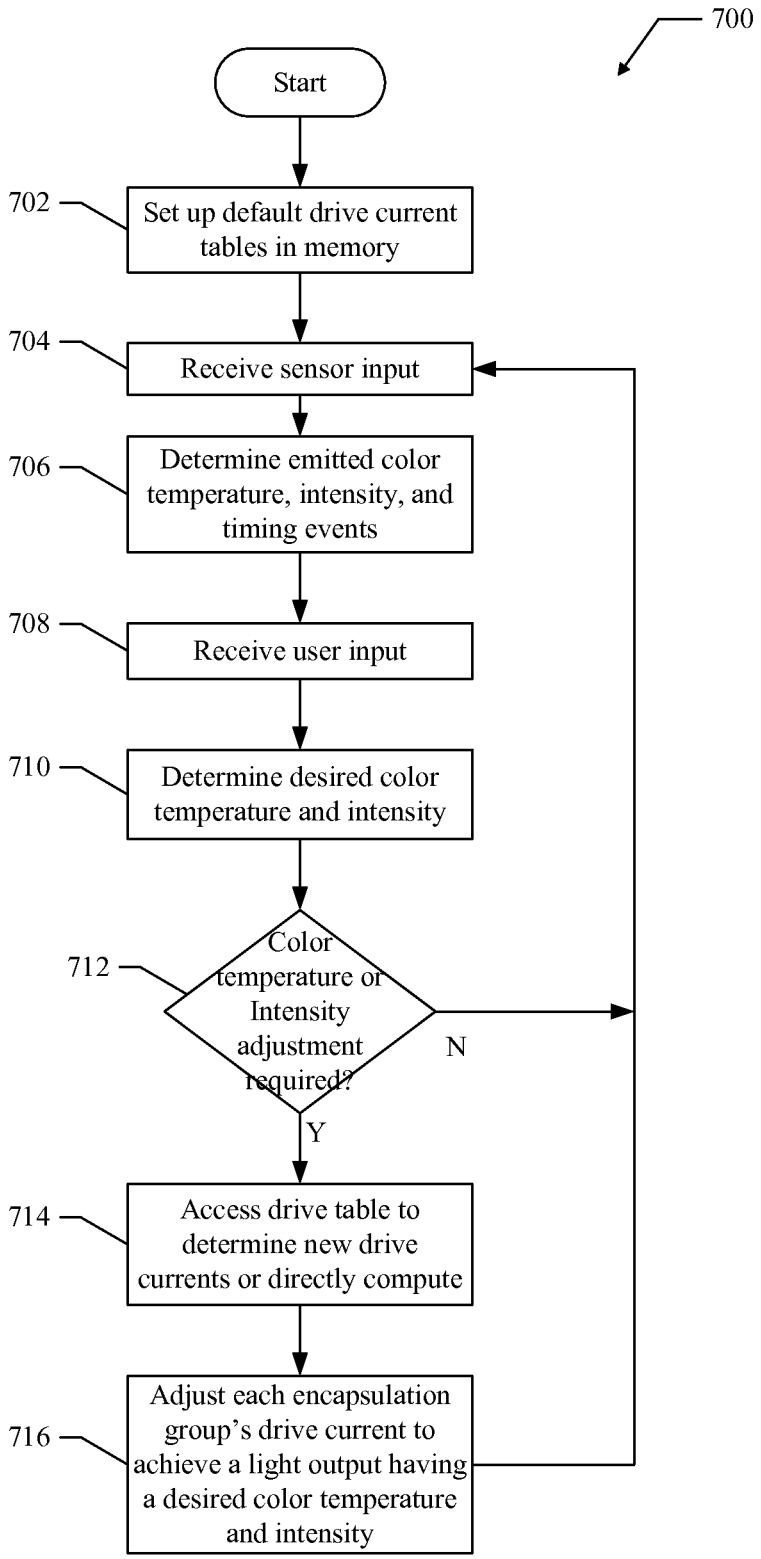
FIG. 7 shows an exemplary method for providing drive currents to drive a color temperature tunable LED light source.

FIG. 7 shows an exemplary method 700 for driving a color temperature tunable light source having multiple encapsulation groups. For example, the method is suitable for use with the drive circuit 300 shown in FIG. 3.

At block 702, default drive current tables are set up in a memory. For example, the default drive current table maybe the drive current table 500 shown in FIG. 5. In one implementation, the default drive current table is stored in the memory 304 during device manufacture or installation.

At block 704, sensor inputs are received. For example, the timing indicators 312, ambient indicators 314, and device indicators 316 are received by the sensor interface 306 and passed to the controller 302.

At block 706, color temperature, intensity, and timing events associated with a light source are determined from the sensor inputs. For example, the controller 302 processes the timing indicators 312, ambient indicators 314, and device indicators 316 to determine various parameters associated with the operation of a color temperature tunable light source.

At block 708, user parameters are received. For example, the controller 302 receives user parameters from the user input 318.

At block 710, a desired color temperature and intensity of a color tunable LED light source is determined. The controller 302 determines the desired color temperature and intensity of the color temperature tunable light source based on the received sensor inputs and user inputs. For example, at a particular time of day a particular color temperature light is desired. The controller 302 may also determine that due to process variation or degradation the light being emitted has drifted from the desired color temperature. Thus, the controller 302 may determine a desired color temperature and/or intensity by processing the sensor information and/or user input as described above.

At block 712, a determination is made as to whether the color temperature or intensity of the LED light source needs to be adjusted. For example, the controller 302 stores information about the current color temperature and intensity of light being emitted from the light source. This information is compared to a desired color temperature determined from the sensor inputs and/or the user input. If the desired color temperature or intensity are different from the current color temperature or intensity, then the controller 302 determines that a color temperature or intensity adjust is necessary. If adjustment is necessary, the method proceeds to block 714. If adjustment is not necessary, the method returns to block 704

At block 714, drive current tables are accessed to determine drive current necessary to achieve the desired light output. For example, the controller 302 accesses the drive current tables in the memory 304 to determine the drive currents necessary to obtained the desired light output. The controller 302 cross references the drive tables with the desired color temperature at the desired intensity to determine the required drive currents. In another implementation, the controller 302 determined the drive currents through direct computation as described above.

At block 716, the drive currents for each encapsulation group of the LED light source are adjust to the appropriate level as determined from the drive current tables. For example, the controller 302 pass the drive current parameters to the current drivers 308 which in turn adjusts the drive currents to the appropriate levels to obtain emitted light having the desired color temperature and intensity.

Therefore, the method 700 operates to provide drive a color temperature tunable LED light source in accordance with aspects of the present invention. It should be noted that the operations of the method 700 may be rearranged or otherwise modified within the scope of the various aspects. Thus, other implementations are possible with the scope of the various aspects described herein.

Figure 8:
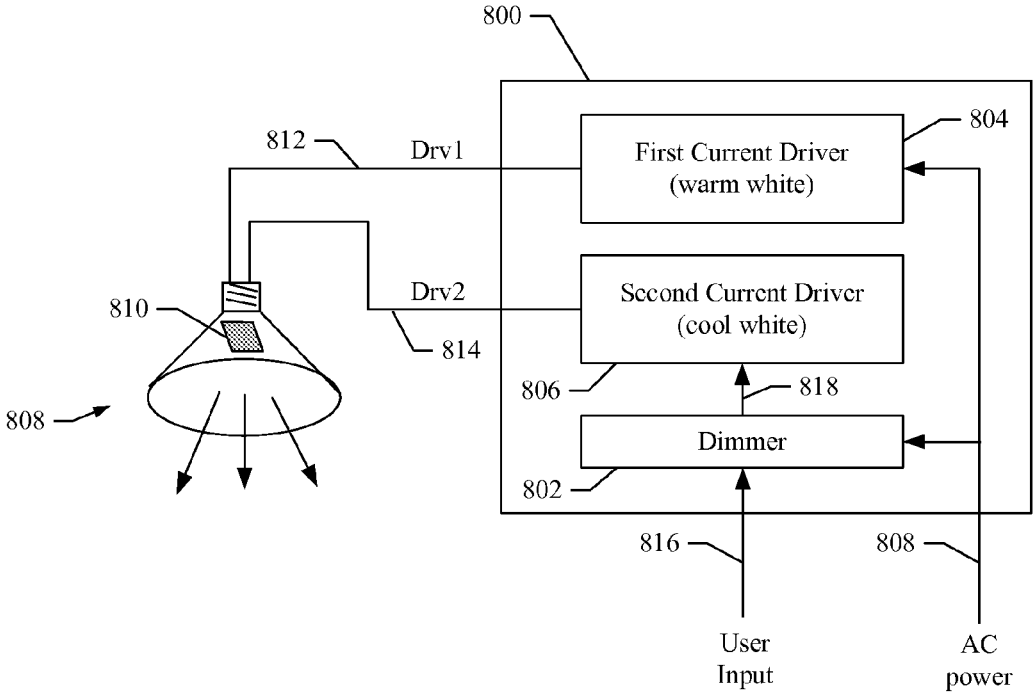
FIG. 8 shows an exemplary alternative drive circuit for use in aspects of a color temperature tunable LED light source.

FIG. 8 shows an exemplary alternative drive circuit 800 for use in aspects of a color temperature tunable LED light source. For example, the drive circuit 800 is suitable for use as the drive circuit 118 shown in FIG. 1. The drive circuit 800 comprises dimmer 802, first current driver 804, and second current driver 806. It should be noted that the drive circuit 800 is just one implementation and that other implementations are possible.

The drive circuit 800 is coupled to drive a color temperature tunable LED light source 810 that is part of a device 808. For example, the color temperature tunable light source 810 may comprise the LED apparatus 100 shown in FIG. 1.

The first current driver 804 comprises discrete hardware and/or hardware executing software that operates to receive AC power 808 and generate a first drive current (Drv1) 812 that is coupled to drive a corresponding encapsulation group of the color temperature tunable LED light source 810. For example, the first drive current 812 is coupled to drive a first group of LED chips of the light source 810 to generate warm color temperature light. In one implementation, the first drive current 812 is set to drive the first group of LED chips at their maximum intensity.

The second current driver 806 comprises discrete hardware and/or hardware executing software that operates to receive adjust AC power 818 and generate a second drive current (Drv2) 814 that is coupled to drive a corresponding encapsulation group of the color temperature tunable LED light source 810. For example, the second drive current 814 is coupled to drive a second group of LED chips of the light source 810 to generate cool color temperature light. In one implementation, the second drive current 814 is adjustable from a fully "off" state to its maximum value based the adjusted AC power 818.

The dimmer 802 comprises one or more of a CPU, processor, gate array, state machine, hardware logic, discrete circuitry, memory elements, and/or hardware executing software. The dimmer 802 operates to receive user parameters 816 and the AC power 808 to generate the adjusted power 818 that is input to the second current driver 806.

In one implementation, the dimmer 802 generates the adjusted AC power 818 by adjusting the AC power input 808 in response to the user parameters 816. For example, the dimmer 802 may reduce the AC power 808 to produce the adjusted AC power 818, which results in a reduced second drive current 814. For example, the dimmer 802 may be a rheostat, potentiometer, or other user operated device which a user can operate to change the adjusted AC power 818 and thereby set the second drive current to obtain a desired color temperature light emitted from the light source 810. For example, when the second drive current 814 is minimized the light output is generated from the first group of LED chips and has a warm color temperature. When the second drive current 814 is increased, the light output is generated by both groups of LED chips and a resulting cool color temperature light is emitted. Thus, in one implementation, the dimmer 802 allows a user to change the intensity and color temperature of the light emitted from the light source 810.

Therefore the drive circuit 800 operates to adjust the drive currents provided to a color tunable LED light source so that the intensity and color temperature can be adjusted.

Figure 9:
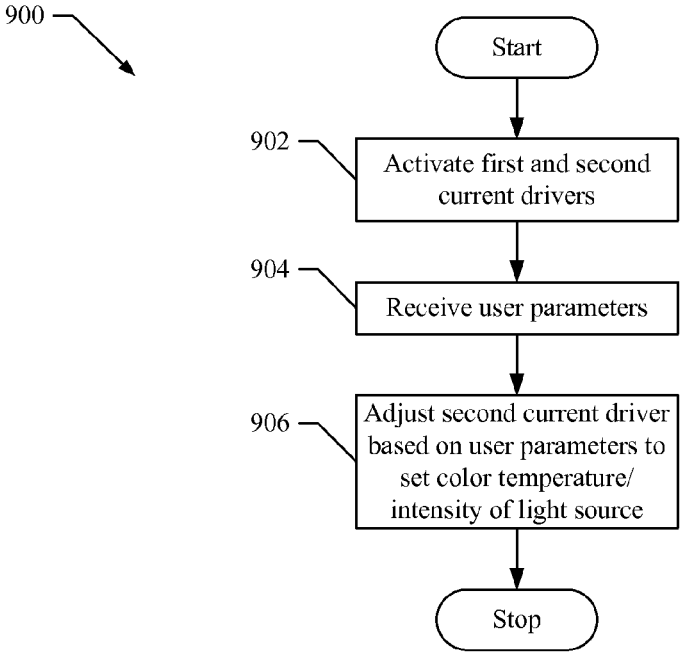
FIG. 9 shows an exemplary alternative method for providing drive currents to drive a color temperature tunable LED light source.

FIG. 9 shows an exemplary method 900 for driving a color temperature tunable light source having multiple encapsulation groups. For example, the method is suitable for use with the drive circuit 300 shown in FIG. 3.

At block 902, first and second drive currents are activated. For example, the first current driver 804 and the second current driver 806 generate the first 812 and second 814 drive currents that are coupled to a color temperature tunable light source 810.

At block 904, user parameters are received. For example, the dimmer 302 receives user parameters from the user input 816 and uses these parameters to generate the adjusted AC power 818.

At block 906, the second drive current is adjusted based on the user parameters to set the color temperature and/or intensity of the light source. For example, the second current driver 806 adjusts the second drive current 814 based on the adjusted AC power 818 so as to adjust the color temperature and/or the intensity of the light emitted from the light source 810.

Therefore, the method 900 operates to adjust the color temperature and/or intensity of a tunable LED light source in accordance with aspects of the present invention. It should be noted that the operations of the method 900 may be rearranged or otherwise modified within the scope of the various aspects. Thus, other implementations are possible with the scope of the various aspects described herein.

Figure 10:
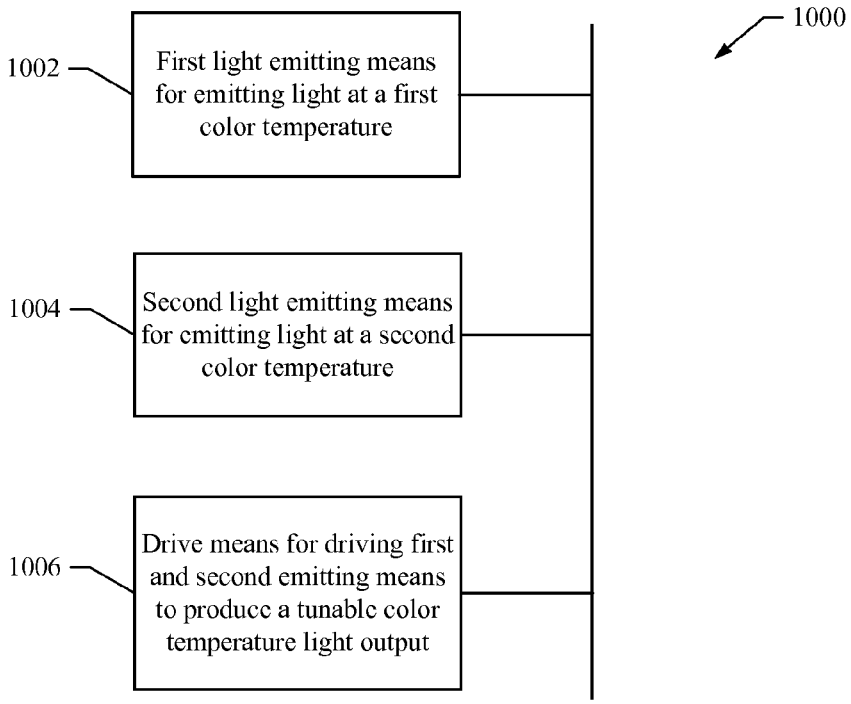
FIG. 10 shows an exemplary LED apparatus constructed in accordance with aspects of a color temperature tunable LED light source.

FIG. 10 shows an exemplary color temperature tunable LED apparatus 1000 constructed in accordance with aspects of a color temperature tunable LED light source.

The apparatus 1000 comprises a first light emitting means for emitting light at a first color temperature. For example, the first light emitting means may be the first group of LED chips within the boundary 110 and encapsulated with the first encapsulation material.

The apparatus 1000 also comprises a second light emitting means for emitting light at a second color temperature. For example, the second light emitting means may be the second group of LED chips between the boundaries 110 and 112 encapsulated with the second encapsulation material.

The apparatus 1000 also comprises a drive means for driving the first and second light emitting means to produce a tunable color temperature light output. For example, in one implementation, the drive means comprises the conductive mounting pads 120 and associated electrical connections to the first and second groups of LED chips shown in FIG. 1. Thus, the apparatus 1000 operates to provide a color temperature tunable white light source.

Figure 11:
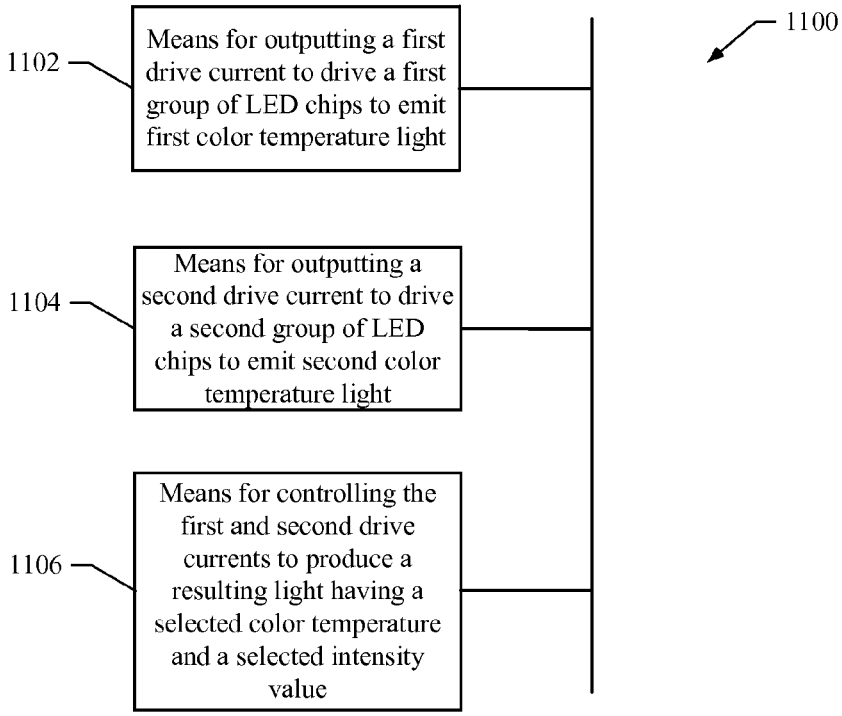
FIG. 11 shows an exemplary drive circuit apparatus constructed in accordance with aspects of a color temperature tunable LED light source.

FIG. 11 shows an exemplary drive circuit apparatus 1100 constructed in accordance with aspects of a color temperature tunable LED light source.

The apparatus 1100 comprises means (1102) for outputting a first drive current to drive a first group of LED chips of the light source to emit first color temperature light, which in an aspect comprises the first current driver 804.

The apparatus 1100 comprises means (1104) to output a second drive current to drive a second group of LED chips of the light source to emit second color temperature light, which in an aspect comprises the second current driver 806.

The apparatus 1100 also comprises means (1106) for controlling the first and second drive currents so that the first color temperature light and the second color temperature light combine to produce a resulting light having a selected color temperature and a selected intensity value, which in an aspect comprises the dimmer 802.

The various aspects of this disclosure are provided to enable one of ordinary skill in the art to practice the present invention. Various modifications to aspects presented throughout this disclosure will be readily apparent to those skilled in the art, and the concepts disclosed herein may be extended to other applications. Thus, the claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims.

Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

Accordingly, while aspects of an efficient LED array have been illustrated and described herein, it will be appreciated that various changes can be made to the aspects without departing from their spirit or essential characteristics. Therefore, the disclosures and descriptions herein are intended to be illustrative, but not limiting, of the scope of the invention, which is set forth in the following claims.

What is claimed is:

1. An apparatus for driving a color temperature tunable light source, the apparatus comprising:

a first group of LED chips mounted on a substrate, the first group comprising at least one LED chip configured to emit blue light encapsulated by a first phosphor;

a second group of LED chips mounted on the substrate, the second group comprising LED chips, at least one of the LED chips being configured to emit blue light encapsulated by a second phosphor; wherein the first group of LED chips is mounted in a region that is located within the second group of LED chips;

a current driver configured to output a first drive current to drive the first group of LED chips of the light source to emit first color temperature light and to output a second drive current to drive the second group of LED chips of the light source to emit second color temperature light; and a controller coupled to the current driver and configured to control the first and second drive currents so that the first color temperature light and the second color temperature light combine to produce a resulting light having a selected color temperature and a selected intensity value.

2. The apparatus of claim 1, wherein the controller determines the first and second drive currents based on mathematical calculations.

3. The apparatus of claim 2, wherein the mathematical calculations comprise:

$$Iw=L/W*[(Te-T)/(Te-Tw)]; \text{ and}$$

$$Ie=L/C*[(T-Tw)/(Te-Tw)].$$

4. The apparatus of claim 1, wherein the controller determines the first and second drive currents based on drive current tables.

5. The apparatus of claim 4, wherein the drive current tables are stored in a memory.

6. The apparatus of claim 1, further comprising a sensor interface coupled to receive one or more control signals that are used by the controller to determine the first and second drive currents.

7. The apparatus of claim 6, wherein the one or more control signals comprises at least one of timing indicators, ambient indicators, and device indicators.

8. The apparatus of claim 1, wherein the controller is configured to receive user input to determine the first and second drive currents.

9. The apparatus of claim 1, wherein the current driver outputs each of the first and second drive currents as constant currents or currents pulsed at a selected pulse rate.

10. The apparatus of claim 1, wherein the first color temperature light has a different color temperature than the second color temperature light.

11. The apparatus of claim 1, wherein the first color temperature light has a color temperature that is different from the second color temperature light by at least 300K.

12. The apparatus of claim 1, wherein the first color temperature light is warm white light and the second color temperature light is cool white light.

13. An apparatus for driving a color temperature tunable light source, the apparatus comprising:

a first group of LED chips mounted on a substrate, the first group comprising at least one LED chip configured to emit blue light encapsulated by a first phosphor;

a second group of LED chips mounted on the substrate, the second group comprising LED chips, at least one of the LED chips being configured to emit blue light encapsulated by a second phosphor; wherein the first group of LED chips is mounted in a region that is located within the second group of LED chips;

means for outputting a first drive current to drive the first group of LED chips of the light source to emit first color temperature light and to output a second drive current to drive the second group of LED chips of the light source to emit second color temperature light; and means for controlling the first and second drive currents so that the first color temperature light and the second color temperature light combine to produce a resulting light having a selected color temperature and a selected intensity value.

14. The apparatus of claim 13, wherein the means for controlling determines the first and second drive currents based on mathematical calculations.

15. The apparatus of claim 14, wherein the mathematical calculations comprise:

$$Iw=L/W*[(Te-T)/(Te-Tw)]; \text{ and}$$

$$Ie=L/C*[(T-Tw)/(Te-Tw)].$$

16. The apparatus of claim 13, wherein the means for controlling determines the first and second drive currents based on drive current tables.

17. The apparatus of claim 16, wherein the drive current tables are stored in a memory means.

18. The apparatus of claim 13, further comprising means for receiving one or more control signals that are used by the means for controlling to determine the first and second drive currents.

19. The apparatus of claim 18, wherein the one or more control signals comprises at least one of timing indicators, ambient indicators, and device indicators.

20. The apparatus of claim 13, wherein the means for controlling receives user input to determine the first and second drive currents.

21. The apparatus of claim 13, wherein the means for outputting outputs each of the first and second drive currents as constant currents or currents pulsed at a selected pulse rate.

22. The apparatus of claim 13, wherein the first color temperature light has a different color temperature than the second color temperature light.

23. The apparatus of claim 13, wherein the first color temperature light has a color temperature that is different from the second color temperature light by at least 300K.

24. The apparatus of claim 13, wherein the first color temperature light is warm white light and the second color temperature light is cool white light.

25. A method for driving a color temperature tunable light source, the method comprising:

mounting a first group of LED chips on a substrate, the first group comprising at least one LED chip configured to emit blue light encapsulated by a first phosphor;

mounting a second group of LED chips on a substrate, the second group comprising LED chips, at least one of the LED chips being configured to emit blue light encapsulated by a second phosphor; wherein the first group of LED chips is mounted in a region that is located within the second group of LED chips;

outputting a first drive current to drive the first group of LED chips of the light source to emit first color temperature light and to output a second drive current to drive the second group of LED chips of the light source to emit second color temperature light; and controlling the first and second drive currents so that the first color temperature light and the second color temperature light combine to produce a resulting light having a selected color temperature and a selected intensity value.

26. The method of claim 25, wherein said controlling comprises determining the first and second drive currents based on mathematical calculations.

27. The method of claim 26, wherein the mathematical calculations comprise:

$$Iw=L/W*[(Te-T)/(Te-Tw)]; \text{ and}$$

$$Ie=L/C*[(T-Tw)/(Te-Tw)].$$

28. The method of claim 25, wherein said controlling comprises determining the first and second drive currents based on drive current tables.

29. The method of claim 28, wherein the drive current tables are stored in a memory.

30. The method of claim 25, further comprising receiving one or more control signals that are used to determine the first and second drive currents.

31. The method of claim 30, wherein the one or more control signals comprises at least one of timing indicators, ambient indicators, and device indicators.

32. The method of claim 25, wherein said controlling comprises receiving user input to determine the first and second drive currents.

33. The method of claim 25, wherein said outputting comprises outputting each of the first and second drive currents as constant currents or currents pulsed at a selected pulse rate.

34. The method of claim 25, wherein the first color temperature light has a different color temperature than the second color temperature light.

35. The method of claim 25, wherein the first color temperature light has a color temperature that is different from the second color temperature light by at least 300K.

36. The method of claim 25, wherein the first color temperature light is warm white light and the second color temperature light is cool white light.

37. A computer program product for driving a color temperature tunable light source, the computer program product comprising: a non-transitory computer-readable medium embodying codes executable by a processor to: output a first drive current to drive a first group of LED chips of the light source mounted on a substrate, the first group of LED chips comprising at least one LED chip configured to emit blue light encapsulated by a first phosphor; Output a second current to drive a second group of LED chips of the light source mounted on the substrate, the second group comprising LED chips, at least one of the LED chips being configured to emit blue light encapsulated by a second phosphor; wherein the first group of LED chips is mounted in a region that is located within the second group of LED chips; and control the first and second drive currents so that the first color temperature light and the second color temperature light combine to produce a resulting light having a selected color temperature and a selected intensity value.

38. The non-transitory computer-readable medium of claim 37, wherein said codes are configured to cause the processor to determine the first and second drive currents based on mathematical calculations.

39. The non-transitory computer-readable medium of claim 38, wherein the mathematical calculations comprise:

$$Iw=L/W*[(Te-T)/(Te-Tw)]; \text{ and}$$

$$Ie=L/C*[(T-Tw)/(Te-Tw)].$$

40. The non-transitory computer-readable medium of claim 37, wherein said codes are configured to cause the processor to determine the first and second drive currents based on drive current tables.

41. The non-transitory computer-readable medium of claim 40, wherein said codes are configured to cause the processor to retrieve the drive current tables from a memory.

42. The non-transitory computer-readable medium of claim 37, wherein said codes are configured to cause the processor to receive one or more control signals that are used to determine the first and second drive currents.

43. The non-transitory computer-readable medium of claim 42, wherein the one or more control signals comprises at least one of timing indicators, ambient indicators, and device indicators.

44. The non-transitory computer-readable medium of claim 37, wherein said codes are configured to cause the processor to receive user input to determine the first and second drive currents.

45. The non-transitory computer-readable medium of claim 37, wherein said codes are configured to cause the processor to output each of the first and second drive currents as constant currents or currents pulsed at a selected pulse rate.

46. The non-transitory computer-readable medium of claim 37, wherein the first color temperature light has a different color temperature than the second color temperature light.

47. The non-transitory computer-readable medium of claim 37, wherein the first color temperature light has a color temperature that is different from the second color temperature light by at least 300K.

48. The non-transitory computer-readable medium of claim 37, wherein the first color temperature light is warm white light and the second color temperature light is cool white light.

49. An apparatus for driving a color temperature tunable light source, the apparatus comprising:

a first group of LED chips mounted on a substrate, the first group comprising at least one LED chip configured to emit blue light encapsulated by a first phosphor;

a second group of LED chips mounted on the substrate, the second group comprising LED chips, at least one of the LED chips being configured to emit blue light encapsulated by a second phosphor; wherein the first group of LED chips is mounted in a region that is located within the second group of LED chips;

a first current driver configured to output a first drive current to drive the first group of LED chips of the light source to emit first color temperature light;

a second current driver configured to output a second drive current to drive the second group of LED chips of the light source to emit second color temperature light, and a dimmer configured to adjust the second drive current so that the first color temperature light and the second color temperature light combine to produce a resulting light having a selected color temperature and a selected intensity value.

50. The apparatus of claim 49, wherein the dimmer adjusts the second drive current based on user input.

51. The apparatus of claim 50, wherein the dimmer adjust AC power based on the user input to produce adjusted AC power that is coupled to the second current driver to adjust the second drive current.

52. The apparatus of claim 49, wherein the first color temperature light has a different color temperature than the second color temperature light.

53. The apparatus of claim 49, wherein the first color temperature light has a color temperature that is different from the second color temperature light by at least 300K.

54. The apparatus of claim 49, wherein the first color temperature light is warm white light and the second color temperature light is cool white light.

* * * * *